US008266859B1

(12) United States Patent
Harrington

(10) Patent No.: US 8,266,859 B1
(45) Date of Patent: Sep. 18, 2012

(54) CONCRETE WALL FORMING SYSTEM

(76) Inventor: James Thomas Harrington, Miami, FL (US)

( * ) Notice: Subject to any disclaimer, the term of this patent is extended or adjusted under 35 U.S.C. 154(b) by 1898 days.

(21) Appl. No.: 11/168,864

(22) Filed: Jun. 28, 2005

(51) Int. Cl.
*E04B 2/86* (2006.01)

(52) U.S. Cl. ..... 52/426; 52/435

(58) Field of Classification Search ..... 249/426, 249/427, 442, 435, 440, 441; 52/562, 774, 52/780, 781, 764, 379, 383, 434
See application file for complete search history.

(56) References Cited

U.S. PATENT DOCUMENTS

| | | | | | |
|---|---|---|---|---|---|
| 581,940 | A | * | 5/1897 | Pelton | 52/509 |
| 778,583 | A | * | 12/1904 | Jarvis | 249/44 |
| 1,188,959 | A | * | 6/1916 | McAlarney | 52/600 |
| 1,202,103 | A | * | 10/1916 | Ringrose | 52/482 |
| 1,446,916 | A | * | 2/1923 | McElheny | 52/349 |
| 1,554,420 | A | * | 9/1925 | Donley | 249/34 |
| 1,815,075 | A | * | 7/1931 | Sersen | 52/355 |
| 2,104,870 | A | * | 1/1938 | Levy | 52/781 |
| 2,313,880 | A | * | 3/1943 | Leggett, Sr | 249/27 |
| 2,378,850 | A | * | 6/1945 | Hyre | 249/210 |
| 2,763,048 | A | * | 9/1956 | Sullivan | 249/188 |
| 3,566,561 | A | * | 3/1971 | Tozer | 52/282.1 |
| 4,057,947 | A | * | 11/1977 | Oide | 52/781 |
| 4,621,477 | A | * | 11/1986 | Kinst | 52/780 |
| 5,040,344 | A | * | 8/1991 | Durand | 52/426 |
| 5,065,562 | A | * | 11/1991 | Larsen et al. | 52/772 |
| 5,092,100 | A | * | 3/1992 | Lambert et al. | 52/774 |
| 5,611,183 | A | * | 3/1997 | Kim | 52/426 |
| 5,649,401 | A | | 7/1997 | Harrington | |
| 5,755,070 | A | * | 5/1998 | Hohmann | 52/489.1 |
| 6,042,301 | A | * | 3/2000 | Sovran | 405/112 |
| 6,250,033 | B1 | * | 6/2001 | Zelinsky | 52/426 |
| 6,293,068 | B1 | | 9/2001 | Harrington | |
| 6,438,903 | B1 | * | 8/2002 | Weiss | 52/79.1 |
| 6,735,915 | B1 | * | 5/2004 | Johnson, III | 52/379 |
| 6,826,880 | B2 | * | 12/2004 | Yost et al. | 52/426 |
| 2004/0231263 | A1 | * | 11/2004 | McKay | 52/426 |

* cited by examiner

*Primary Examiner* — Michael Safavi
(74) *Attorney, Agent, or Firm* — Alvin S. Blum

(57) ABSTRACT

A reinforced concrete wall system assembles rigid panels into two form walls in spaced apart relationship to securely hold poured concrete and reinforcing materials there between. The panels may include insulating foam. The panels are held securely side by side within a form wall by elongate connectors that have paired channels into which edges of the panels snugly fit. Each connector has brackets extending into the concrete space. Brackets are provided with perforations to receive tie rods. Each tie rod ties a bracket from one form wall to a bracket extending from the other form wall. This holds the space being filled with concrete together. The perforations are formed to resist releasing the tie rod once it has been inserted. Reinforcing steel is positioned by fastening to the tie rods.

6 Claims, 7 Drawing Sheets

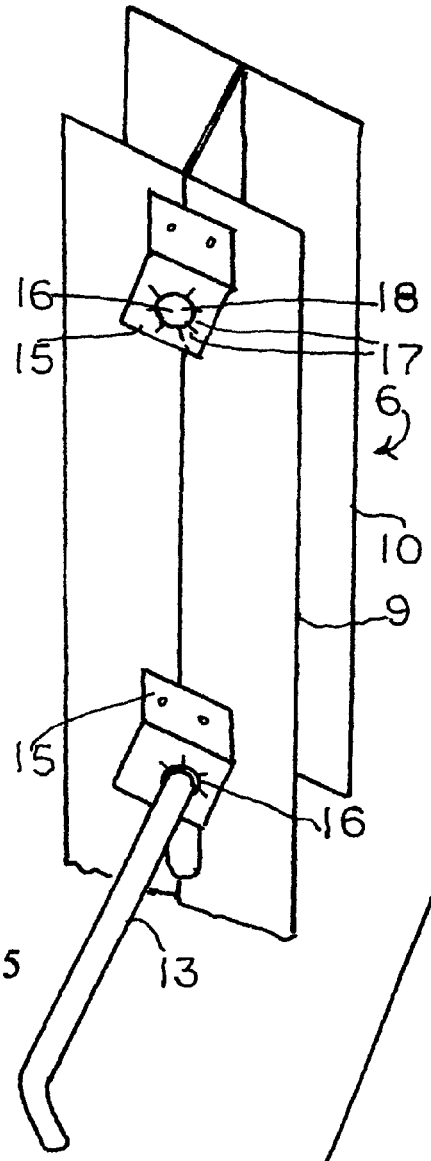
FIG. 5
FIG. 4
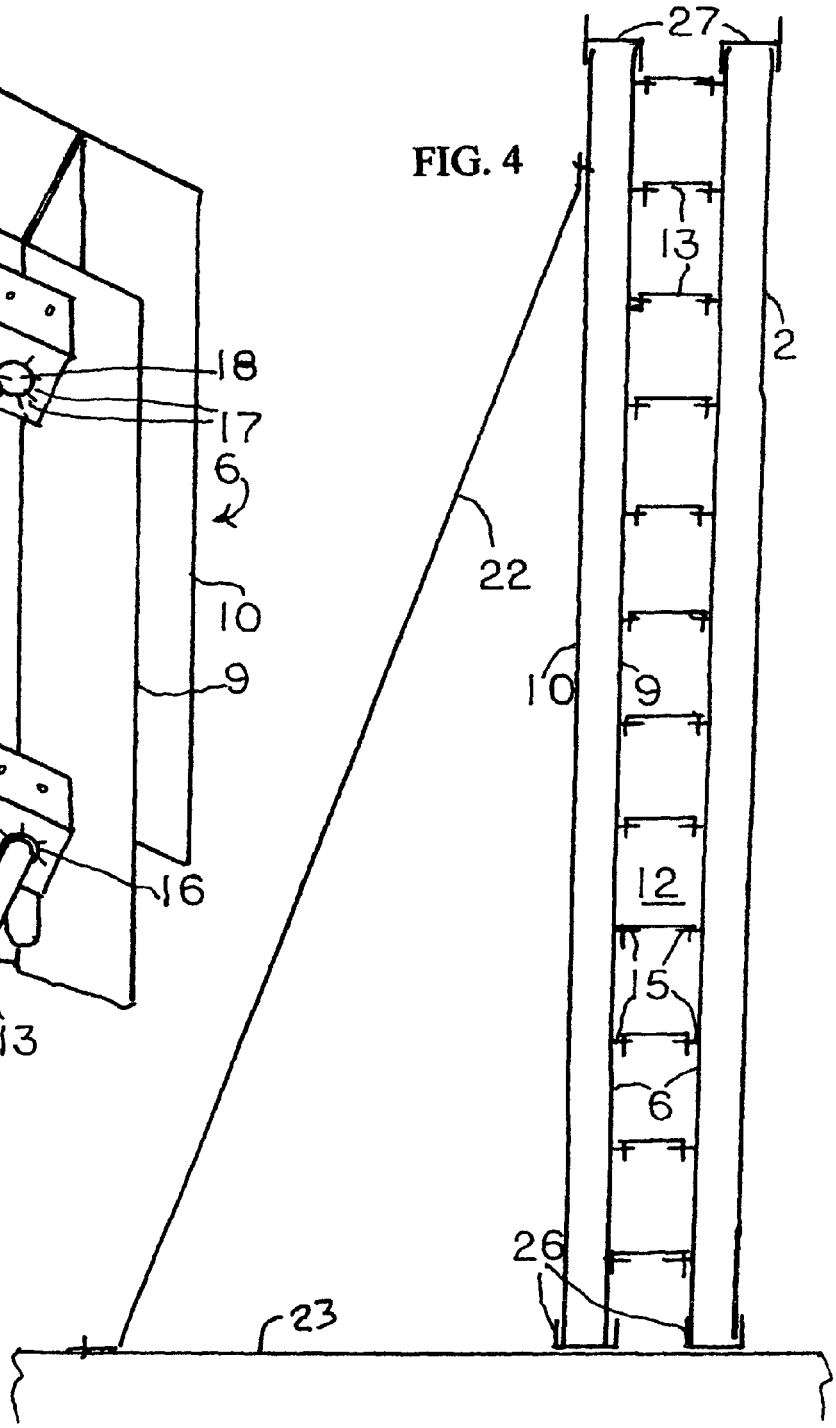

CONCRETE WALL FORMING SYSTEM

BACKGROUND OF THE INVENTION

This invention relates to a system of assembling rigid panels in spaced apart relationship to securely hold poured concrete and reinforcing materials therebetween while the reinforced concrete hardens. U.S. Pat. Nos. 6,293,068 issued Sep. 25, 2001 and 5,649,401 issued Jul. 22, 1997, both to the applicant, teach rigid foam panels that are joined together by connector channels to form concrete-impervious, parallel spaced-apart walls.

The spaced-apart walls define a cavity between them for receiving steel reinforcing rods and poured concrete. The result is a reinforced concrete wall with foam insulation on both faces. The channels of one wall are spaced apart from the channels of the second wall by horizontal tie elements affixed at each end to one of the channels in each wall. It may be more useful and economic to provide different means of holding the channels apart.

SUMMARY OF THE INVENTION

It is accordingly an object of the invention to provide an improved rigid panel reinforced concrete forming system that may be used with rigid panels that may include insulating foam on one or both sides of the wall, or may be made with other types of rigid panels, as required. It is another object of the invention to provide channels for the system that use separate tie elements that removably attach to the channels for enhanced versatility and economy of manufacture. It is another object of the invention to provide for the use of panels of sufficient rigidity that they may extend up high enough for a single story concrete pour so that only vertical channels are required.

The channels of the invention have parallel flanges connected by a web. They are provided with perforated brackets that extend outwardly from the face of the flange that will be contacted by the concrete. The perforations can receive tie rods or reinforcing bars of steel bent to define the spacing between the walls. These rods can in turn support reinforcing bars. The perforations in the brackets may take a shape that freely admits a rod, but resists removal of the rod. The brackets of the invention may comprise planar elements that are affixed to the channels. Alternatively, the brackets may comprise tabs formed by cutting slits in a portion of the flange and bending it outwardly to form a right angle to the balance of the flange.

These and other objects, features, and advantages of the invention will become apparent when the detailed description is studied in conjunction with the drawings, in which like elements are designated by like reference characters in the various drawing figures.

BRIEF DESCRIPTION OF THE DRAWINGS

FIG. 4 is a sectional view taken through line 4-4 of FIG. 1.

FIG. 5 is a detail perspective view of a portion of a connector of FIG. 1.

DETAILED DESCRIPTION OF PREFERRED EMBODIMENTS

Figures 1, 2, 3:
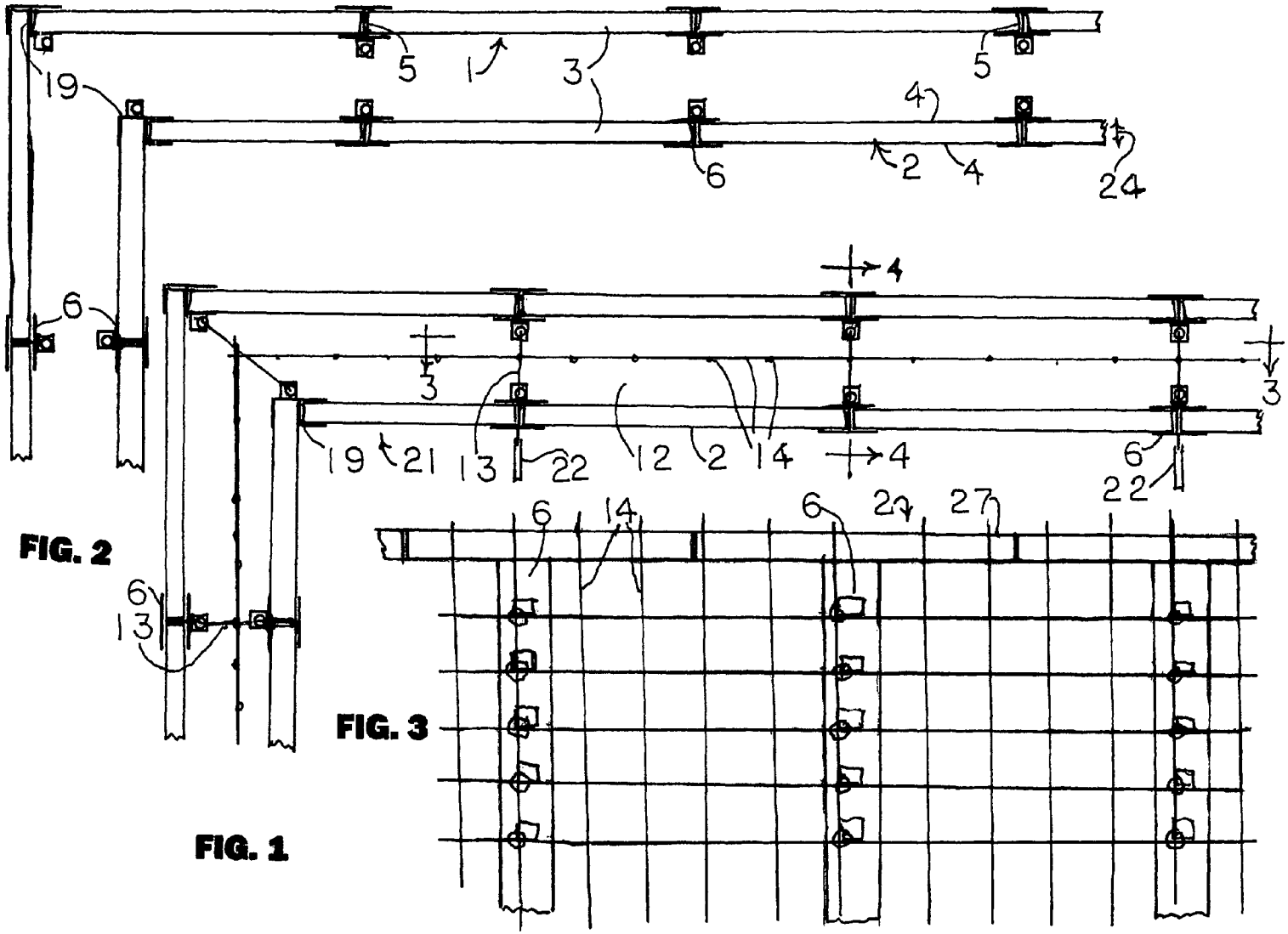
FIG. 1 is a top view of a form wall of the invention prior to concrete pouring.
FIG. 2 is a top view as in FIG. 1 with reinforcing bars and tie rods removed for clarity of illustration.
FIG. 3 is sectional view taken through line 3-3 of FIG. 1.

Referring now to FIGS. 1-5, a portion of a concrete wall forming system 21 of the invention is shown with a first concrete-impervious form wall 1 and a parallel second concrete-impervious form wall 2 held spaced apart by tie rods 13. The tie rods support reinforcing bars 14 within a space 12 defined between the form walls into which concrete is to be poured. Each form wall is comprised of a plurality of rigid panels 3 that have straight edges 5, and opposed broad faces 4 defining a first thickness 24. The panels may include insulating foam, if desired. The panels are sufficiently rigid to support the poured concrete until it has set. The panels are also sufficiently impervious to the concrete until it has set. A plurality of elongate rigid panel connectors 6 holds the panels in place. In this embodiment of the invention, the long axes 8 of the connectors are all vertical, and the panels are eight feet tall to make a house wall in one pour. In other embodiments of this invention, some of the connectors may be horizontal such as those shown in applicant's earlier patents. Each panel connector 6 has two channels 7. Each channel has a pair of opposed flanges 9 and 10, and a web 11 joining the flanges. The web width 25 closely corresponds to the first thickness 24 of the panel so that the panel edge 5 will fit snugly into the channel. The connector 6 for joining together two panels side by side in a common plane has the two channels joined together along their webs 11, as best seen in FIG. 5. A plurality of brackets 15 extend out orthogonally from the flanges 9 that will be in contact with the concrete. Each bracket 15 is provided with at least one perforation 16 to receive a tie rod therein. The perforations may be specially constructed to securely hold a rod inserted therein. The inner clear opening 18 is made smaller then the rod to be inserted. Radial cuts are made around the opening to form flexible barbs 17 or petals. When a rod is inserted, it bends the petals in the direction of rod motion. They are scraping against the sides of the rod. They act as barbs on a fishhook, resisting withdrawal of the rod. This is very useful in assembling the form wall, since it facilitates mounting the reinforcing rods 14 to the tie rods on one wall 2 as shown in FIG. 3 before the second wall 1 is erected. The reinforcing steel may be individual reinforcing bars (rebars), or welded wire fabric, as desired. The tie rods are inserted into the brackets on wall 2, the rebars or fabric is wired to the center of the tie rods, then the second wall is erected. As each connector of the second wall is positioned, the free end of each tie rods is inserted into its bracket. Then a panel is fitted into that connector, and the next connector is mounted onto the free edge of the panel. As best seen in FIG. 4, base channels 26 may be pinned to the slab to receive the connectors and panels at their bottoms. Corner connectors 19 join adjacent panels together at right angles with web of one channel adjacent the flange of the other channel. They also have brackets 15 to hold the corners in position.

The flanges 10 that will not be in contact with the concrete may be attached to a diagonal support strut 22 fixed to a base such as slab 23 to maintain the assembly vertical. Alternatively, the strut may be attached to a cap channel 27 that engages the tops of the channels and the tops of the panels.

Figure 7:
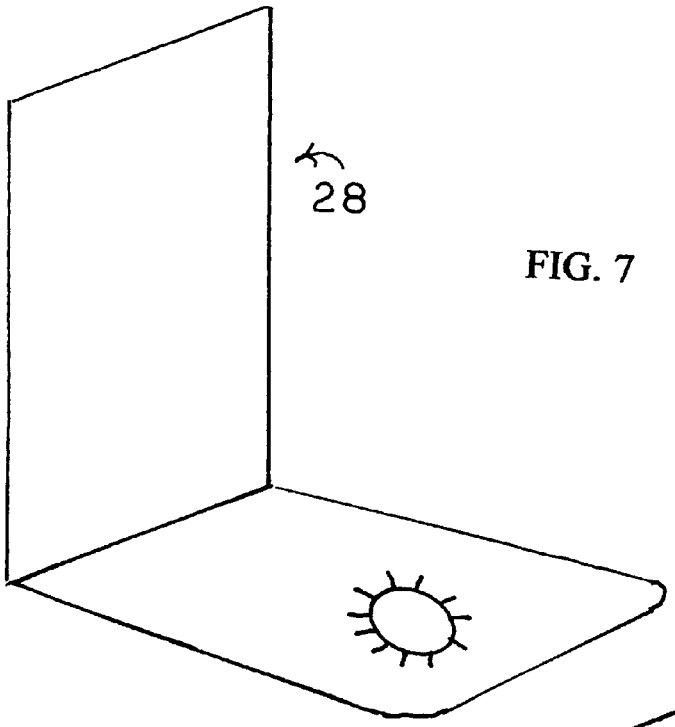
FIG. 7 is a perspective view of a bracket of the invention prior to affixing to a connector.
Figure 8:
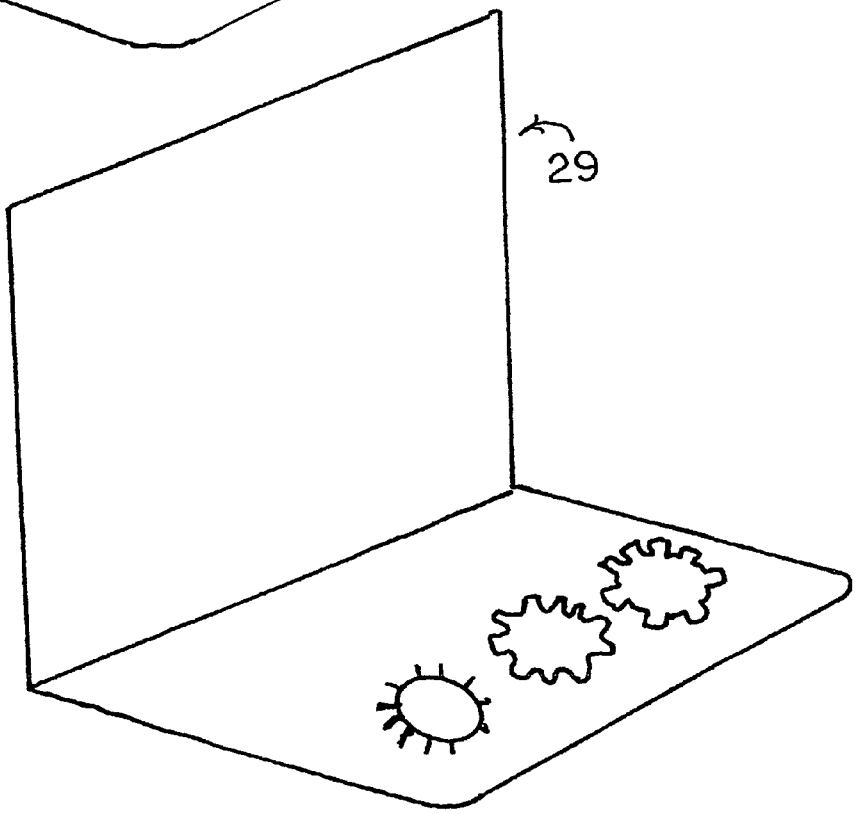
FIG. 8 is a perspective view of another bracket of the invention prior to affixing to a connector.

Connectors may be constructed by forming brackets such as the single aperture bracket 28 of FIG. 7, or the multiple aperture bracket 29 of FIG. 8, that are then affixed to the connector by means well known in the art such as welding and riveting.

Figure 6:
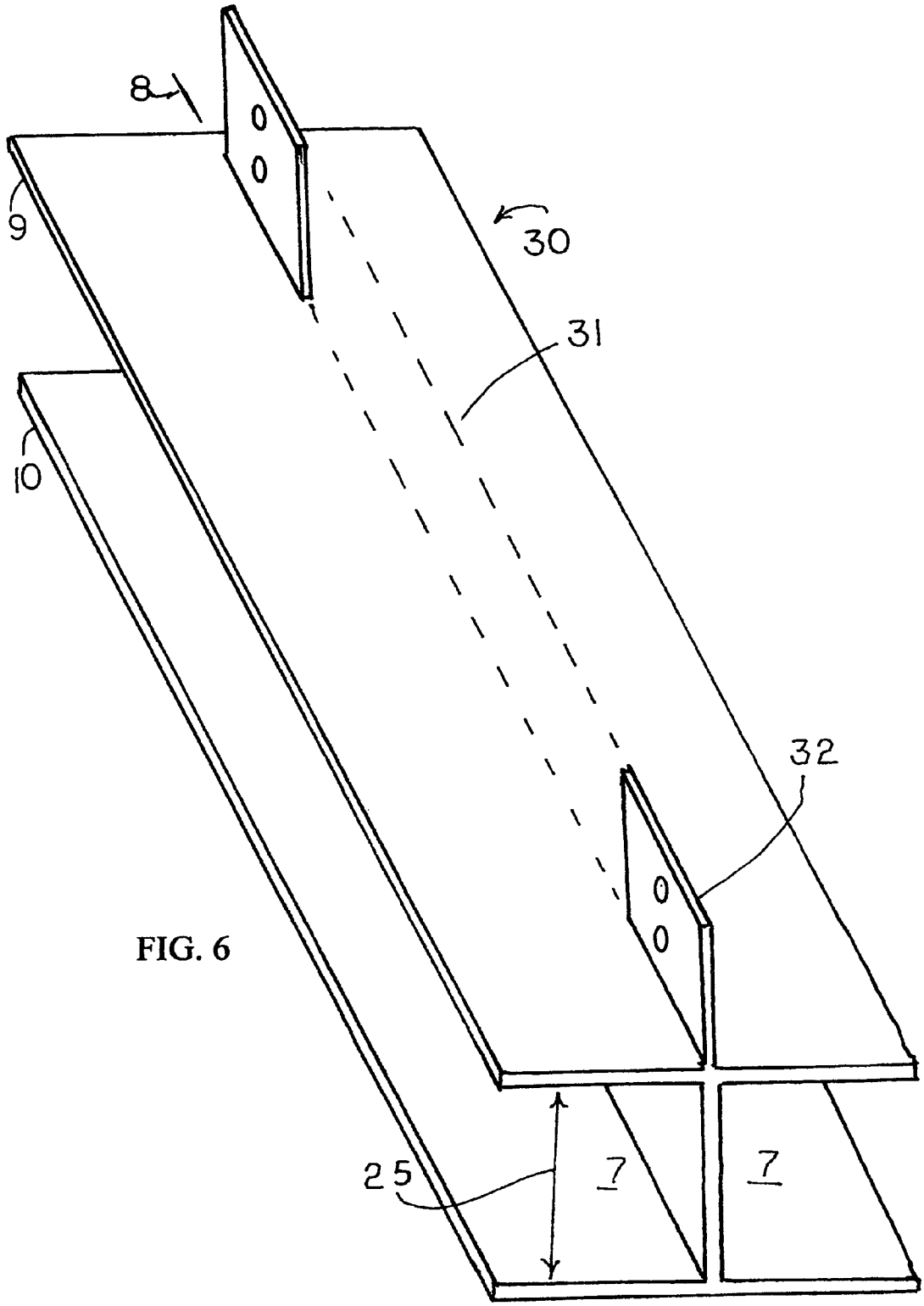
FIG. 6 is a perspective view of a connector of the invention formed from an extrusion.

FIG. 6 shows a connector 30 formed by extrusion. The two channels 7 share a common web 11. An elongate wing 31 extends along the long axis 8 of the connector. Most of the wing is cut away to leave only the brackets 32 that are perforated.

Figure 9:
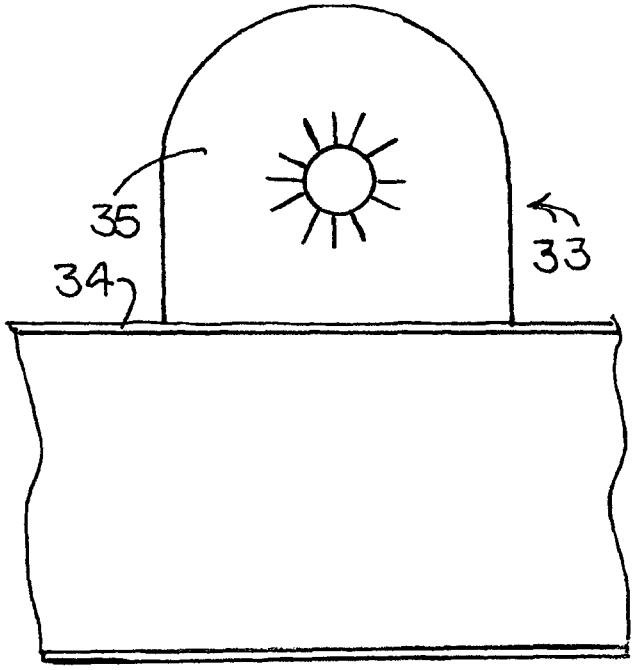
FIG. 9 is a top view of another embodiment of a connector of the invention.
Figure 10:
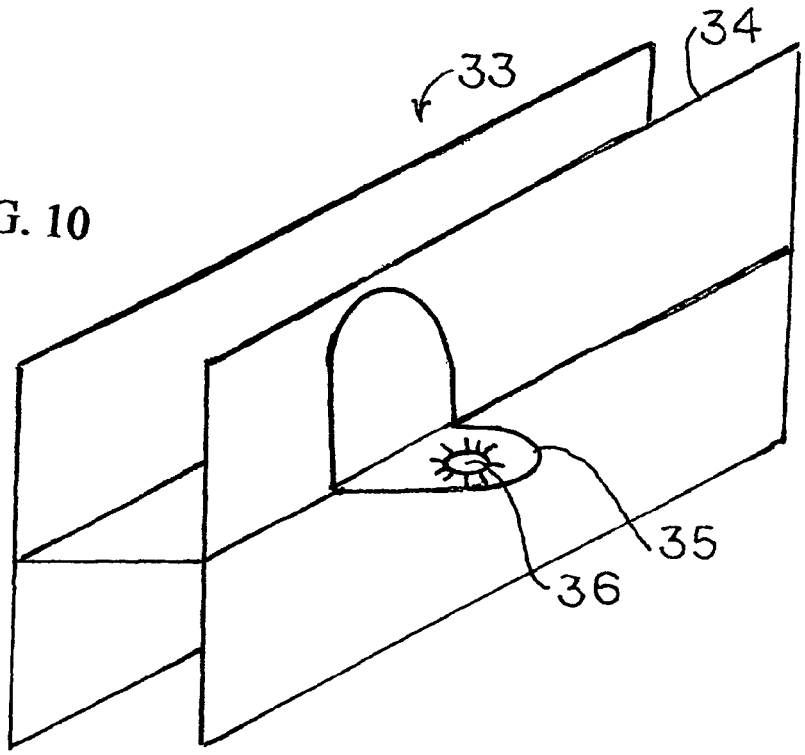
FIG. 10 is a perspective view of the connector of FIG. 9.

FIGS. 9 and 10 illustrate a connector 33 of the invention in which a portion of the flange 34 is punched out to form a tab 35 with specially shaped aperture 36 that is bent out at right angles to the flange.

Figure 11:
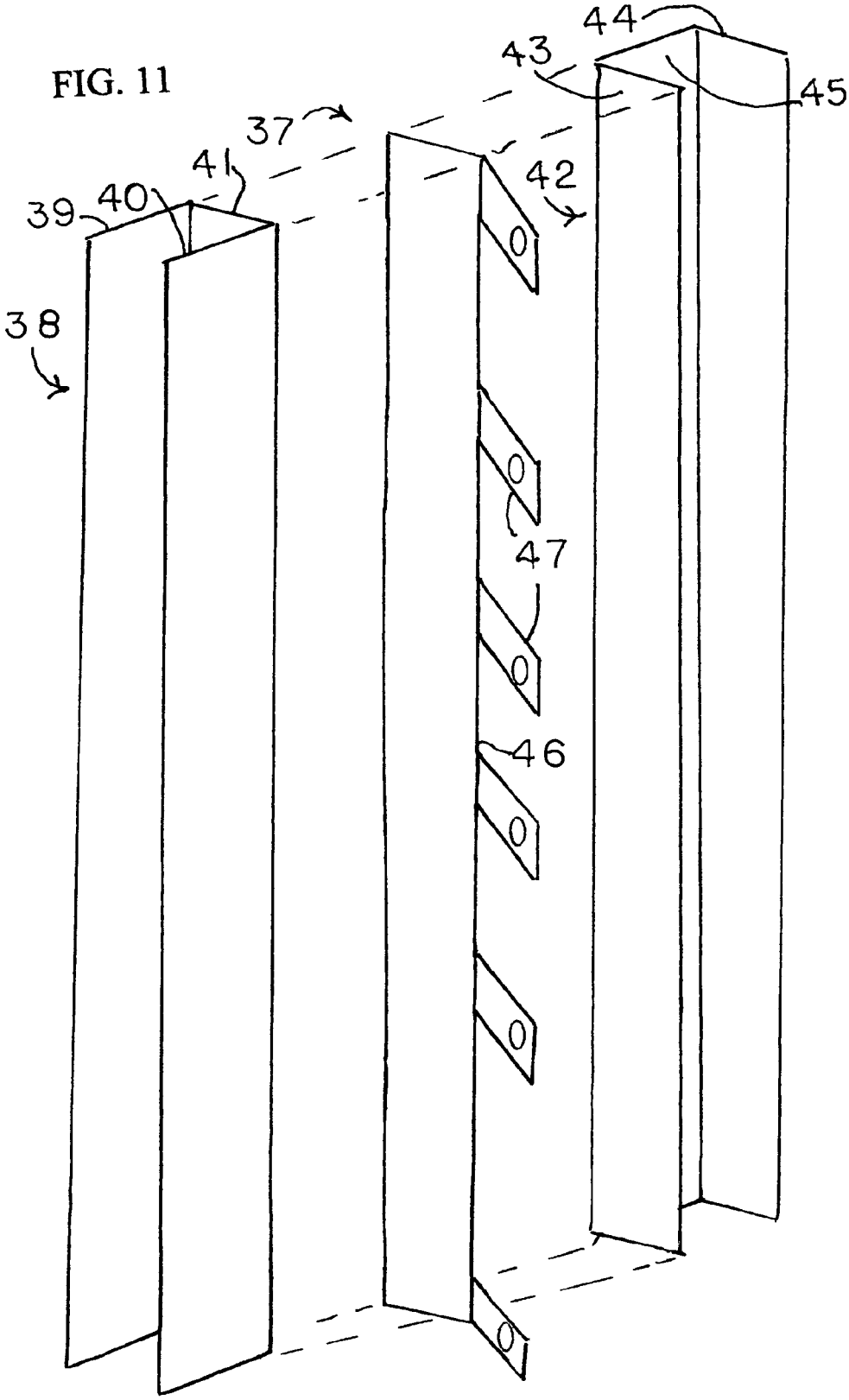
FIG. 11 is an exploded view of another embodiment of the invention.

FIG. 11 illustrates a connector 37 of the invention for joining panels side by side at right angles. Channel 38 is made up of first member 39 and second member 40 spaced apart and joined by third member 41. Channel 42 is made up of first member 43 and second member 44 spaced apart and joined by third member 45. The first member 39 of channel 38 is joined along its length to the third member 45 of channel 42 so that two panels may be joined together side by side at right angles by inserting their edges into the channels. The brackets 47 are part of a base strip 46 that is interposed between members 39 and 45 at the time the two channels are joined together such as by welding, or riveting, for example.

Figure 12:
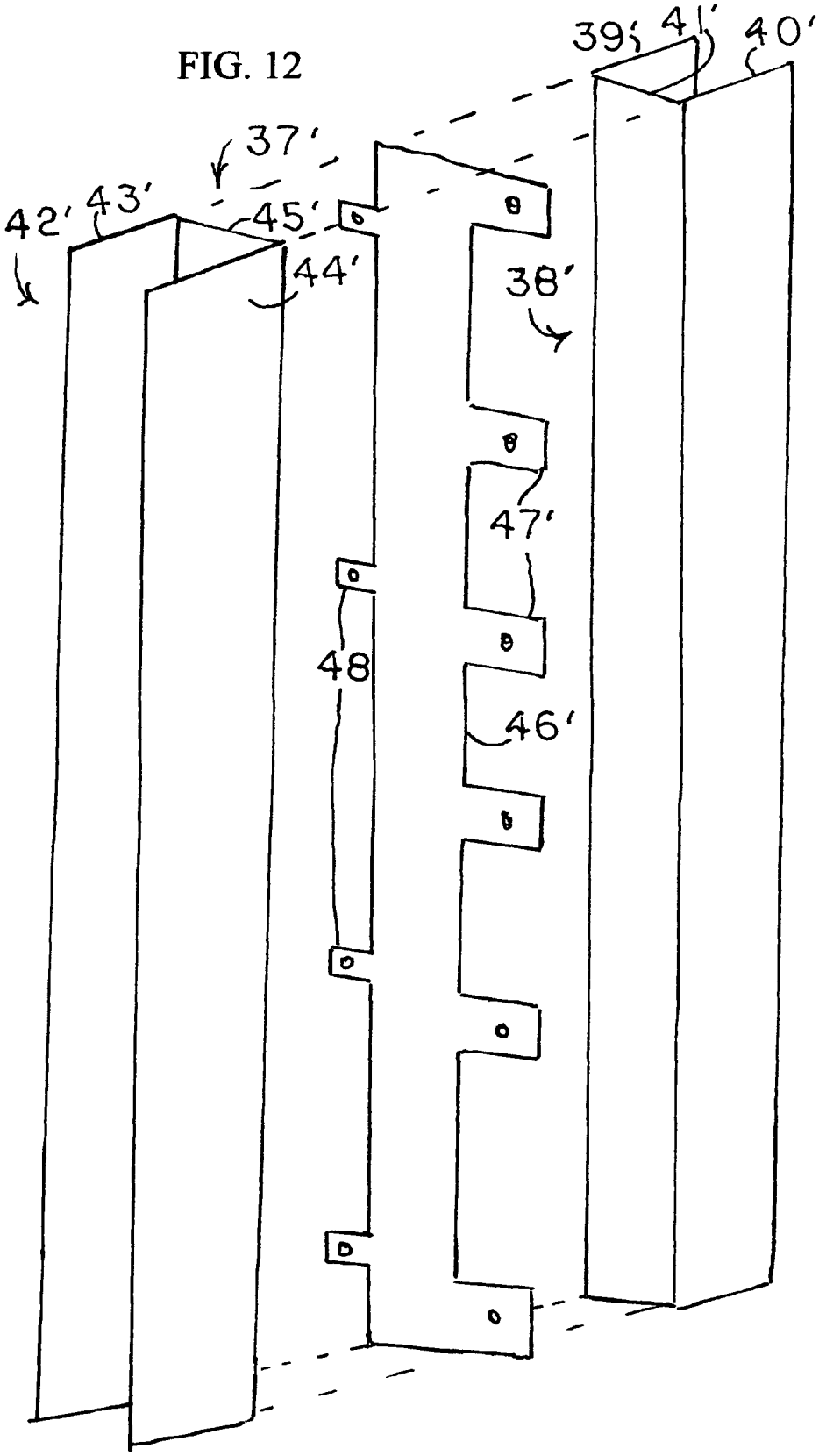
FIG. 12 is an exploded view of another embodiment of the invention.

FIG. 12 illustrates a connector 37' of the invention for joining two panels side by side in a common plane. Channel 38' is made up of first member 39' and second member 40' spaced apart and joined by third member 41'. Channel 42' is made up of first member 43' and second member 44' spaced apart and joined by third member 45'. The third member 41' of channel 38' is joined along its length to the third member 45' of channel 42' so that two panels may be joined together side by side by inserting their edges into the channels. The plurality of spaced-apart brackets 47' are part of a base strip 46' that is interposed between members 41' and 45' at the time the two channels are joined together such as by welding, or riveting, for example. Brackets 48 extending from the connector to an area on the outer side of the form wall that will not be in contact with the poured concrete may be provided for attaching to support struts, such as the support strut 22 of FIG. 4, or finish wall surfaces such as stucco, plaster or paneling.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A concrete wall forming system comprising:

a) a first concrete impervious form wall and a second concrete impervious form wall substantially parallel to one another and spaced apart from one another to define a pouring space therebetween constructed to receive and hold reinforcing rods and poured concrete;

b) each form wall comprising a plurality of rigid panels, the panels having broad faces spaced apart by a first thickness and straight edges;

c) a plurality of elongate panel connectors constructed for interlocking the edges of the panels to one another;

d) each panel connector having two channels, each channel having a long axis with a pair of flanges and a web joining the flanges, the web having a web width corresponding closely to the first thickness so that a panel edge fits snugly into the channel;

e) a plurality of spaced-apart tie rod brackets extending out orthogonally from the connector at a flange that will be adjacent the pouring space; and f) at least one perforation in each of the rod brackets constructed for receiving a tie rod therein, the tie rod to engage a perforation in a corresponding bracket in an adjacent form wall to define the pouring space between the form walls; and g) the tie rod constructed for supporting reinforcing bars within the pouring space.

2. The system according to claim 1 in which the at least one perforation is constructed to facilitate movement of the tie rod there through in a first direction and to resist movement in a second direction to thereby more securely hold the tie rod in place.

3. The system according to claim 2 in which the at least one perforation includes perforations constructed to hold reinforcing bars.

4. The system according to claim 1 in which the at least one perforation includes perforations constructed to hold reinforcing bars.

5. The system according to claim 1 further comprising brackets extending orthogonally from the connector to an area on the outer side of the form wall away from the pouring space.

6. The system according to claim 2 in which the at least one perforation has a clear inner opening that is smaller than the bar to be held therein, and radial cuts extend outwardly from the opening to thereby admit the bar with retention.

* * * * *